United States Patent [19]

Takagaki

[11] 4,158,197

[45] Jun. 12, 1979

[54] PENDANT WITH AN ALARM BUILT IN

[76] Inventor: Mitsuhiro Takagaki, 1-4-29, Taira-machi, Meguro-ku, Tokyo, Japan

[21] Appl. No.: 844,158

[22] Filed: Oct. 21, 1977

[51] Int. Cl.[2] ..... G08B 15/00

[52] U.S. Cl. ..... 340/574; 340/514; 340/693

[58] Field of Search ..... 340/283, 277, 220, 279, 340/321

[56] References Cited

U.S. PATENT DOCUMENTS

| | | | |
|---|---|---|---|
| 3,163,856 | 12/1964 | Kirby | 340/279 |
| 3,614,763 | 10/1971 | Yannuzzi | 340/283 |
| 3,794,791 | 2/1974 | Thomson | 340/321 |
| 3,810,146 | 5/1974 | Lieb | 340/279 |

*Primary Examiner*—Glen R. Swann, III

*Attorney, Agent, or Firm*—Fred Philpitt

[57] ABSTRACT

The body of a pendant is of hollow construction to accommodate therein a battery, a buzzer etc. to form an electric circuit. A pair of normally closed contact elements is included, as one element, in the electric circuit; the contact elements ordinarily receiving therebetween an insulating insertion member to break the electric circuit. The insulating insertion member is designed to be detachably inserted through an opening provided in the upper end of the pendant body, the insertion member having a projection to connect the pendant body to a chain.

3 Claims, 4 Drawing Figures

PENDANT WITH AN ALARM BUILT IN

BACKGROUND OF THE INVENTION

This invention relates to a pendant for personal ornaments generally and more particularly to a pendant with an alarm built in.

It often happens that a woman on her way home at night on a deserted street is violated or robbed of her money and goods. It will thus be advisable for a woman to put a whistle, a buzzer or the like in her handbag and to carry such bag with her as a measure of self-defense. These known self-defense devices, however, will not always meet the sudden need of use of the devices in case of emergency as they are in a bag and cannot be taken out therefrom immediately. Apparently, a woman in an emergency situation is in great fear and not under the calm or self-composed condition to take out the devices from her bag at her will. Much time will inevitably be involved.

BRIEF SUMMARY OF THE INVENTION

It is therefore a general object of the present invention to provide a pendant which can be used speedily as an alarm in case of emergency.

It is a further object of the present invention to provide a pendant with an alarm built in, wherein the alarming mechanism is designed to be inspected or tested very easily.

A pendant with an alarm built in according to the present invention comprises a pendant body of hollow construction to accommodate therein a battery, a buzzer etc. to form an electric circuit, a pair of normally-closed contact elements in the electric circuit as one element to close the circuit when in need, and an insulating insertion member which is to be detachably held between the contact elements to break electric contact in an ordinary state, the pendant body having at its upper end an opening through which the insulating insertion member is to be inserted, the insertion member having a projection to connect the pendant body to a chain, such that immediately after the insulating insertion member has been pulled out from the pendant body, a current flows to close the circuit and the buzzer is caused to produce a warning sound.

The pendant according to the present invention is further provided with a pushbutton inspection mechanism to enable the user to inspect or test, without necessity of pulling out the insertion member, if the battery installed is of enough amount of power to properly operate the buzzer. Explanation about this inspection mechanism will appear more in detail in the description of preferred embodiments.

BRIEF DESCRIPTION OF THE DRAWINGS

The present invention will now be described in greater detail with reference to the accompanying drawings, in which.

DETAILED DESCRIPTION OF PREFERRED EMBODIMENTS

Figure 3:
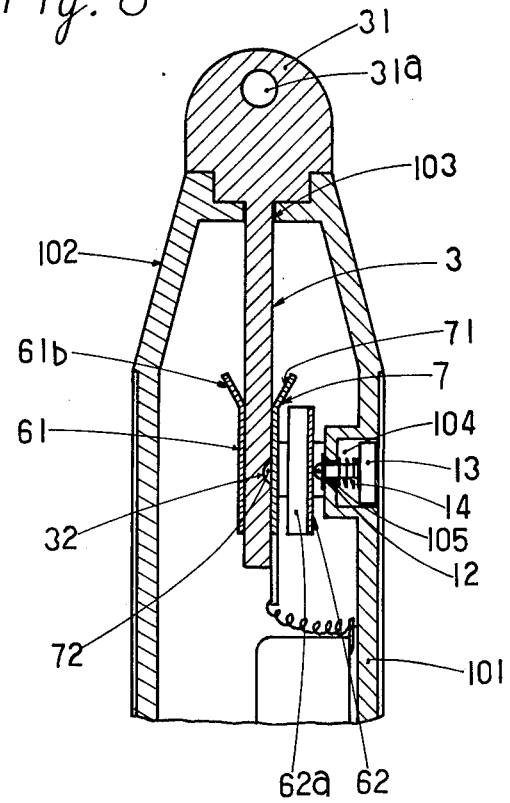
FIG. 3 is a longitudinal sectional view taken on line III—III of FIG. 2.

Referring now in detail to the drawings, wherein preferred embodiments according to the present invention are shown, reference numeral 1 designates generally a pendant body and 2 a chain. The pendant body 1 consists of two covering members 101, 102 which are joined together to form a hollow construction. This body 1 is provided at its upper end portion with an opening 103 (FIG. 3) through which an insulating insertion member designated by a reference numeral 3 is designed to pass. Installed in the hollow space of the pendant body 1 are a buzzer 4, a battery 5, a pair of contact elements 6, 7 etc. to form an electric circuit.

Figure 4:
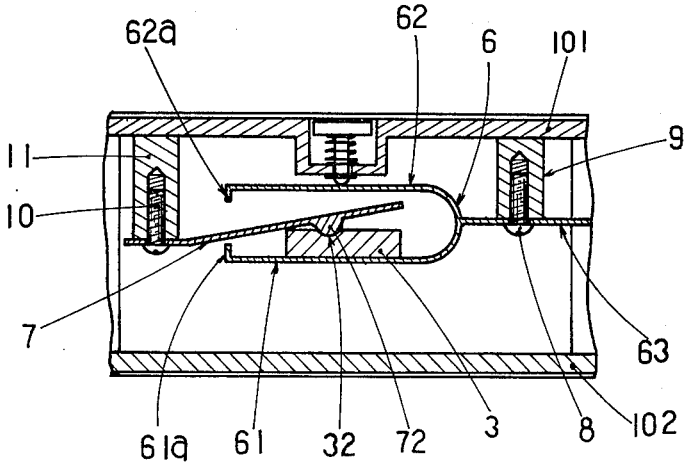
FIG. 4 is a cross-sectional view taken on line IV—IV of FIG. 2.

As is shown in FIG. 4, the contact element 6 is partially divided into two branches 61, 62 to represent U shape. Both forward ends of the branches 61, 62 are bent inwardly to form contacts 61*a*, 62*a* and the upper edge of the branch 61 is slightly outwardly bent to form a guide member 61*b*. Base portion 63 of the contact element 6 is fixed by means of a screw 8 to an insulating boss 9 which is projecting out from the member 101. The contact element 7 is designed to be in contact with the contact 61*a* of the contact element 6 when it is free from any force. The upper edge of the contact element 7 is slightly bent toward the branch 62 to form another guide member 71 facing the guide member 61*b* previously described. On the surface of the contact element 7 facing the branch 61, a convexity 72 is formed. The contact element 7 is fixed by means of a screw 10 to an insulating boss 11 projecting out from the wall of the covering member 101.

The insertion member 3 is made of insulating material and represents generally a narrow band plate. This insertion member 3 has at its upper end an integrally formed connecting portion 31 provided with a hole 31*a* through which the chain 2 is to pass, and is designed to be inserted in between the branch 61 of the contact element 6 and the contact element 7. On the surface of the insertion member 3 facing the contact element 7, a concavity 32 to meet the previously discussed convexity 72 is provided so that the insertion member 3, when inserted, may properly be held in the position.

On the surface of the covering member 101 facing the contact branch 62, there is formed an inwardly concaved portion 104 the bottom wall thereof being provided with a hole 105 through which an insulating operation rod 12 having at its outer end a button 13 is designed to pass, a coiled spring 14 being installed between the bottom surface of the concaved portion 104 and the button 13. One end of the coiled spring 14 is secured to the covering member 101 and the other end thereof is secured to the insulating operation rod 12, so that the forward end of the operation rod 12 may be held in contact with or adjacent to the contact branch 62 and the button 13 may be positioned within the concaved portion 104.

Figure 1:
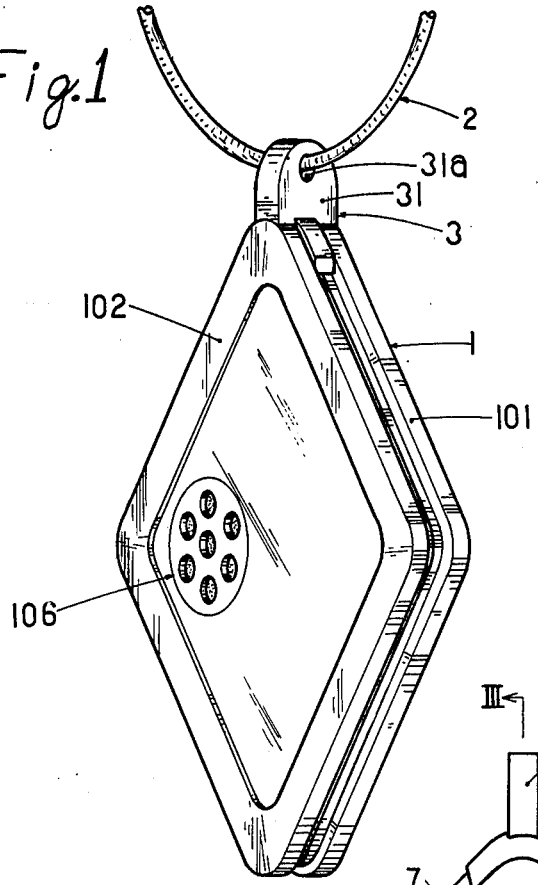
FIG. 1 is a perspective view of the pendant with an alarm built in according to the present invention, showing external appearance thereof.
Figure 2:
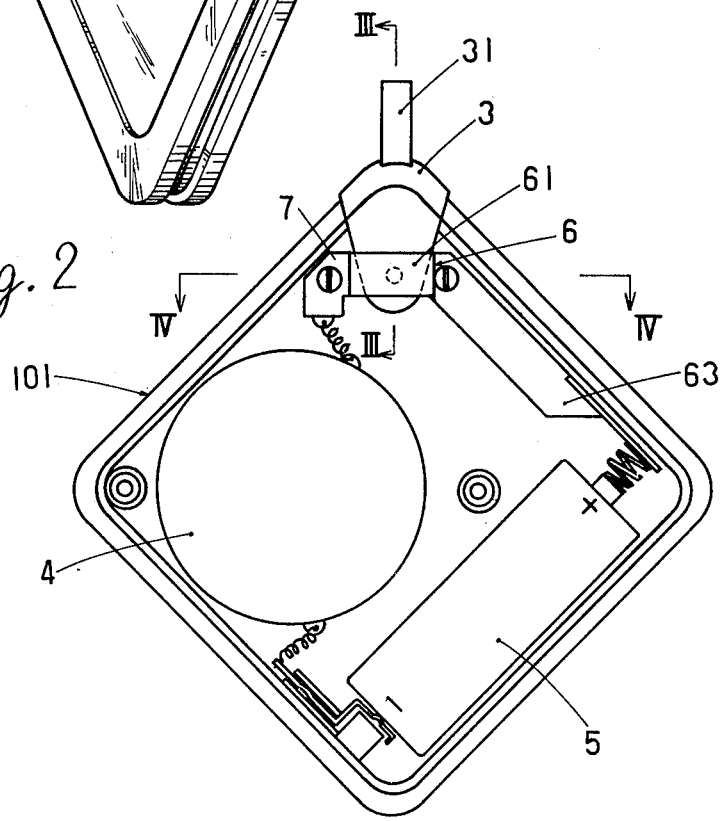
FIG. 2 is a front view with a cover of the pendant body opened to show internal mechanism.

The covering member 102 which constitutes the hollow pendant body 1 in association with the covering member 101 is provided with a sound emitting hole 106, as shown in FIG. 1.

The pendant body 1 is to be decorated with a pattern suitable for personal ornaments, though such pattern does not appear in any of the drawings.

As will be understood from the foregoing description, the pendant with an alarm built in according to the present invention is to be carried with the user as personal ornaments or a necklace. Usually, the insertion member 3 will be held in between the contact element 6 and the contact element 7 with the cooperative engagement of the concavity 32 and the convexity 72, the electric circuit being caused to remain open so as not to operate the buzzer 4. Once, however, when the pendant body 1 forcibly pulled, the concavity 32 of the insertion member 3 will be caused to be out of engagement with the convexity 72 of the contact element 7, whereby the insertion member 3 is forced to be pulled out from the pendant body 1. The contact element 7 will then return, by its own resilient force, to its original position and be in contact with the bent contact 61*a* of the branch contact 61 to form the closed electric circuit. In consequence thereof, voltage of the battery 5 is applied to the buzzer 4 to produce a warning sound.

Since the pendant according to the present invention is of very unique and compact construction which can always be carried with the user as personal ornaments, it can allow the user to instantly protect herself in an emergent situation, as compared with the known devices which are to be carried in the users' bag.

The pushbutton 13 provided in one covering member of the pendant will allow the user to inspect or test, without pulling out the insertion member 3, if the electric circuit is in normal condition to properly operate the buzzer. More specifically, as the button 13 is pushed in, the insulating operation rod 12 is caused to be moved inwardly against the force of the coiled spring 14 and the contact branch 62 is caused to be in contact with the contact element 7, whereby an electrically closed circuit is formed, to produce a warning sound in case the battery installed is of enough amount of power and the electric circuit is in normal state. By the utilization of this pushbutton inspection mechanism, the user can expect accurate operation of the alarm in case of emergency.

While a preferred embodiment has been shown and described, variations thereto will occur to those skilled in the art within the scope of the present inventive concepts which are delineated by the following claims.

What is claimed is:

1. A pendant with an alarm built in, comprising a pendant body of hollow construction having an opening at its upper end; a buzzer and a battery installed within the hollow space of said pendant body; a pair of contact elements to constitute an electric circuit in association with said buzzer and said battery, one of said elements being resilient and tending to contact the other element and being provided with a convexity; an insulating insertion member provided with a concavity to accommodate said convexity of said one contact element, one end of which constitutes a connecting means to connect said pendant body to a chain, the insulating insertion member being designed to be inserted through said opening of said pendant body between said pair of contact elements and be held in the position by the cooperative engagement between said concavity of said insertion member and said convexity of said one resilient contact element.

2. A pendant with an alarm built in as claimed in claim 1, wherein a pushbutton inspection mechanism is installed in one wall of said pendant body to allow the user to test, without pulling out said insertion member, if the electric circuit is in normal condition to properly operate the buzzer.

3. A pendant with an alarm built in as claimed in claim 1, wherein a sound emitting hole is provided in one wall of said pendant body to emit the sound generated by the buzzer.

* * * * *